United States Patent [19]

White et al.

[11] Patent Number: 4,963,790

[45] Date of Patent: Oct. 16, 1990

[54] LOW WATTAGE METAL HALIDE DISCHARGE LAMP

[75] Inventors: Robert S. White, Beverly; James C. Morris, Wakefield, both of Mass.

[73] Assignee: GTE Products Corporation, Danvers, Mass.

[21] Appl. No.: 814,140

[22] Filed: Dec. 27, 1985

[51] Int. Cl.[5] ..... H01J 61/34

[52] U.S. Cl. ..... 313/25; 313/634; 313/324

[58] Field of Search ..... 313/17, 25, 27, 634, 313/623, 324, 580, 579

[56] References Cited

U.S. PATENT DOCUMENTS

| | | | |
|---|---|---|---|
| 2,009,215 | 7/1935 | Abshagen | 176/122 |
| 3,250,934 | 5/1966 | Pederson | 313/17 |
| 3,407,327 | 10/1968 | Koury et al. | 313/639 |
| 3,424,935 | 1/1969 | Gungle et al. | 313/227 |
| 3,619,682 | 11/1971 | Lo et al. | 313/22 |
| 3,619,710 | 12/1973 | Waymouth | 315/47 |
| 3,780,331 | 7/1981 | Knochel et al. | 313/219 |
| 4,281,274 | 7/1981 | Bechard | 315/49 |

FOREIGN PATENT DOCUMENTS

| | | | |
|---|---|---|---|
| 163301 | 12/1985 | European Pat. Off. | 313/25 |
| 3134907 | 9/1982 | Fed. Rep. of Germany . | |
| 2028573 | 3/1980 | United Kingdom | 313/25 |

*Primary Examiner*—Kenneth Wieder

*Attorney, Agent, or Firm*—Martha A. Finnegan; José W. Jimenez

[57] ABSTRACT

A low wattage metal halide discharge lamp includes an evacuated envelope wherein is disposed a heat loss reducing member having an arc tube therein and means for interrupting the circuit for the current flow which sustains the electrolytic sodium loss process. In one embodiment, the circuit interruption means includes supporting the arc tube and dome sleeve by a supporting rod that is affixed by a metal strap to the glass stem within the lamp. The primary circuit interrupting effect occurring upon the heat loss reducing member being supported about the arc tube in an electrically insulated manner so as to create a high path of resistance back to the power supply. A substantial reduction of sodium loss along with improved color constancy and voltage stability resulted from interruption of the electrolysis circuit.

5 Claims, 4 Drawing Sheets

| | INITIAL VALUES | CHANGE FROM INITIAL VALUES PER 1000 HR | |
|---|---|---|---|
| | | PRIOR ART | INVENTION |
| LUMENS | 8500 | 13% | 10% |
| CCT, K | 3200 | 280 | -16 |
| COLOR UNIF., MPCD | 3 | 3 | 3 |
| COLOR SHIFT, MPCD | - | 10 | 0 |
| VOLTAGE | 95 | 6.3 | 2.5 |

FIG. 3

LOW WATTAGE METAL HALIDE DISCHARGE LAMP

TECHNICAL FIELD

This invention relates to low wattage metal halide discharge lamps and more particularly to low wattage metal halide discharge lamps configured and electrically connected to provide a reduced rate of sodium loss.

BACKGROUND OF THE INVENTION

Because of their long life and good efficacy, mercury vapor lamps have been used commercially for many years, in spite of the bluish-green light they emitted. The subsequent addition of metal halides particularly sodium halide to the arc tube fill ingredients improved efficiency and produced white light. An example of such a device is the metal arc lamp shown in Koury et al. U.S. Pat. No. 3,407,327 issued Oct. 22, 1968. Because of the improvement in luminous efficacy and color rendition, such lamps have become commercially successful. Accordingly, sodium is an important constituent in the chemical fill ingredients of metal halide lamps since it serves to enhance the red spectral region, lowers the color temperature as well as acting as a so called "arc-fastener" thereby increasing the radiating volume and establishing a more stable arc. Clearly, then the loss of sodium leads to degraded lamp performance and is undesirable. The loss of sodium atoms by the movement of $Na+$ ions through the hot silica of the walls in sodium-containing lamps is well-known. The loss of sodium atoms from NaI frees iodine which can then combine with the mercury in the arc tube to form $HgI_2$, which leads to difficulties in starting and changes in the color of the emitted radiation. Reference may be made to the textbook entitled "Electric Discharge Lamps" by Dr. John Waymouth, M.I.T. Press 1971, (Chapter 10), for a detailed description of the sodium loss process in metal iodine arc lamps. One solution to the problem, which has been adopted by the major lamp manufactures in the United States, has been the so-called "frameless" harness as taught in Gungle et al., U.S. Pat. No. 3,424,935, 1969, "Harness Construction for Metal Arc-Type Lamp". There is evidence that most of the sodium loss is due to a negative charge on the arc tube walls caused by photoelectric emission from the frame side rods used to support the arc tube within the outer bulb in prior art construction. In the "frameless" construction, there are no side rods running alongside the arc tube and the current return wire for the outer end electrode is a fine piece of tungsten wire, sometimes known as the flying lead, spaced as far away from the arc tube as possible and hugging the curve or bulge in the outer bulb. While such "frameless" construction provides an improvement, lamp designs having a heat conserving quartz sleeve and required rigid supporting structure, preclude such frameless construction.

In other metal halide lamp designs, an inert gas fill is introduced within the outer glass jacket or bulb within which are mounted the arc tube and supporting framework to retard the photoelectric currents and reduce sodium loss. However, heat losses due to convection and conduction reduce the efficacy of such inert gas filled lamps which is particularly objectionable in low wattage designs.

Generally, metal halide discharge lamps are of the intermediate or relatively high wattage variety such as about 175 to 1500 watts for example. Also, it is known that the efficacy of the lumen output to input power decreases as the wattage of the lamp decreases. Thus, it has been generally presupposed that at lower wattages, wattages of 100 watts or less, metal halide discharge lamps would be entirely unsatisfactory in so far as efficacy is concerned. In Bechard et al. U.S. Pat. No. 4,281,274 issued July 28, 1981, there is disclosed a jacketed metal halide discharge lamp, combining a miniature arc tube containing sodium iodide and a standby filament within an outer envelop, with a glass sleeve around the arc tube. The glass sleeve is connected to a point of potential which is positive relative to the arc tube, suitably the anode when the arc is operated on D.C. The glass sleeve appears to prevent sodium loss from the arc by trapping ultraviolet light and by shielding the arc from photoelectrons. The space within the outer envelope or bulb is filled with an inactive gas under pressure. Thus, a glass cylinder and a gas filled outer envelope are utilized to reduce the heat loss due to convection currents. However, structures having gas filled envelopes and accompanying convection currents leave something to be desired in reduction of heat loss in so far as relatively high pressure lamps are concerned.

An improvement in such inert gas filled designs providing low wattage is disclosed in the co-pending application entitled: "LOW WATTAGE METAL HALIDE DISCHARGE LAMP" filed Oct. 29, 1984, bearing U.S. Ser. No. 665,471 and assigned to the Assignee of the present application. As will be described in more detail hereinafter, the low wattage metal halide discharge lamp disclosed in said co-pending application includes an evacuated envelope wherein is disposed a heat reducing member having an arc tube therein. The heat reducing member and the arc tube have a metal band and an outer strap member adjacent one another and adjacent an electrode. The metal band, strap member and electrode are all electrically connected to an electrical lead of one polarity whereby sodium losses from the arc tube are reduced. While such design provided an improvement by reducing sodium loss considerably so that the color temperature shift was decreased from 500° K per 1000 hours to 200° per 1000 hours, further improvement was deemed necessary for a commercially successful product.

SUMMARY OF THE INVENTION

An object of the present invention is to provide an improved low wattage metal halide lamp having improved color constancy, voltage stability and reduced sodium loss.

In accordance with the teachings of the present invention, there is provided a metal halide discharge lamp comprising an evacuated glass envelope and a stem member disposed within the envelope having a pair of electrical conductors sealed therein and passing therethrough. A heat loss reducing member is disposed within the envelope, having an outer metal band surrounding and being affixed thereto, along with an arc tube disposed within the heat loss reducing member containing a chemical fill including a halide of sodium and having an electrode at each end thereof with an outer strap member adjacent one of said electrodes. The lamp also includes means for electrically coupling each of said electrodes to each of said electrical conductors, disposed within said envelope, and means for interrupting the circuit for the current flow which sustains the electrolytic sodium loss process, the circuit interrupting means being disposed within the envelope.

BRIEF DESCRIPTION OF THE DRAWINGS

FIG. 3 is a chart showing a comparison of the change from initial values of Lumens; CCT, K; COLOR UNIFORMITY, MPCD: COLOR SHIFT, MPCD and VOLTAGE between the prior art lamp of FIG. 2 and the lamp of the present invention as shown in FIG. 1.

BEST MODE OF CARRYING OUT THE INVENTION

For a better understanding of the present invention, together with other and further objects, advantages and capabilities thereof, reference is made to the following disclosure and appended Claims in connection with the above described drawings.

Figure 1:
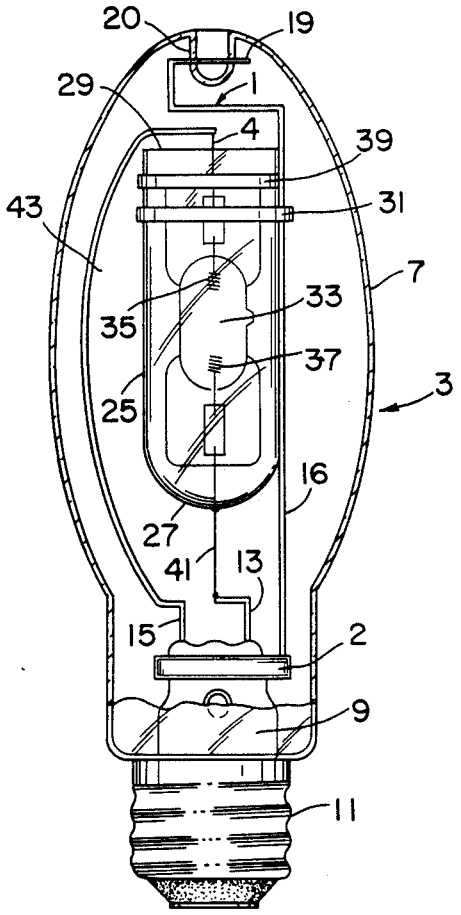
FIG. 1 is an elevational view, partly in cross-section, of one embodiment of the low wattage metal halide lamp in accordance with the invention.
Figure 2:
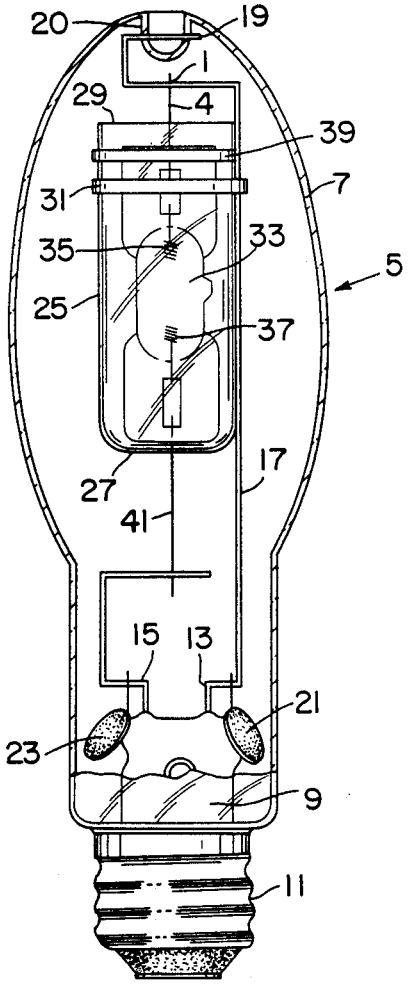
FIG. 2 PRIOR ART
FIG. 2 is an elevational view, partly in cross-section of a prior art low wattage metal halide lamp.

Referring to FIGS. 1 and 2 of the drawings, there are illustrated low wattage metal halide discharge lamps 3 and 5. Each of the lamps 3 and 5 contain the following corresponding parts and construction: An evacuated outer envelope 7. The evacuated outer envelope 7 is hermetically sealed to a glass stem member 9. An external base 11, formed for easy connection to an electrical source, is affixed to the hermetically sealed stem member 9 and outer envelope 7. A pair of stem lead electrical conductors 13 and 15 are sealed into and pass through stem member 9 and electrically connected to base 11 external of outer envelope 7 to provide access for energization of the discharge lamps. Disposed within envelope 7 is a heat loss reducing member 25 in the form of a quartz sleeve. This heat loss reducing member 25, in this embodiment, includes a domed portion 27, which is positioned closest to a pair of getters 21 and 23 (see FIG. 2) and base 11, and an open-ended portion 29 which is furthest from and faces away from base 11. A metal band 31 surrounds and is affixed to heat loss reducing member 25 and is electrically and mechanically connected to the support member 16 of FIG. 1 and member 17 of FIG. 2, as will be discussed in more detail hereinafter. Within heat loss reducing means 25 is an arc tube 33 having a chemical fill including a sodium halide. In the preferred embodiment the fill includes iodides of sodium and scandium of a ratio in the range of about 20:1 to 28:1. Arc tube 33 also includes a pair of electrodes, 35 and 37, at each end thereof with a metal outer strap member 39 affixed to the outer surface thereof. Strap member 39 is electrically coupled to and mechanically connected to the support member 16 of FIG. 1 and member 17 of FIG. 2.

Reference is now made particularly to FIG. 2. As shown in FIG. 2, electrode 35 is mechanically and electrically connected to support member 17 while electrode 37 is affixed to an electrical conductor 41 which passes through dome portion 27 of heat loss reducing member 25 and is electrically and mechanically connected to electrical conductor 15. Metal strap member 39 is immediately adjacent metal band 31 affixed to the heat loss reducing member 25 and electrode 35 of the arc tube 33. Moreover, strap member 39, metal band 31 and electrode 35 are all electrically connected to the support member 17 and to electrical conductor 13. Also, barium getters 21 and 23 are positioned within and at one end of outer envelope 7 and adjacent glass stem member 9 and external base 11. As is well known, these barium getters 21 and 23 are important in any structure wherein an evacuated or vacuum environment is desired such as in the above-described evacuated outer envelope 7.

Still referring to FIG. 2, electrically conductive support member 17 extends along an axis substantially parallel to the longitudinal axis of the discharge lamp 5 and includes an annular circular configuration 19 adjacent an upper most portion 20 of evacuated outer envelope 7. This annular configuration 19 is in register with upper portion member 20 of outer envelope 7 together with the attachment of the other end of support member 17 to conductor 13, which serves to maintain support member 17 in proper alignment and resistant to deformation due to external shock to discharge lamp 5.

Referring now particularly to FIG. 1 of the drawings, which illustrates the low wattage metal halide lamp made in accordance with the teachings of the present invention, the differences with the prior art lamp of FIG. 2 with respect to construction and arrangement of lamp operating circuit will be herein discussed. As shown in FIG. 1, support member 16 extends along an axis parallel to the longitudinal axis of the discharge lamp 3 and includes at one end an annular configuration 19 in register with upper portion member 20 of the evacuated outer envelope 7 in the same manner as support member 17 of FIG. 2. However, the other end of support member 16 is securely held by strap member 2, which extends around stem member 9 (which is of low electrical conductivity), to stem member 9. Electrical conductor 13 is connected to arc tube conductor lead 41, lead 41 passing through member 25, and not to support member 16 as is the case of lamp 5 of FIG. 2. Similarly FIG. 1, arc tube lead 4 is connected to a return lead 43, that is disposed adjacent member 25, which is connected to conductor stem lead 15 thereby completing the lamp operating circuit. In FIG. 2, arc tube lead 4 is connected to configuration 19 of support member 17.

In summary the present invention provides a means for interrupting the circuit for the current flow which sustains the electrolytic sodium loss process. In the prior art lamp shown in FIG. 2 this circuit is completed via support rod 17 to conductor stem lead 13, and thereafter to the external circuit. In the present invention shown in FIG. 1, support rod 16 is held securely by a strap member 2 around stem member 9. Since the stem 9 is of low electrical conductivity, this connection, in essence, effectively interrupts the undesirable electrolytic circuit. Other alternatives are possible for effectively interrupting the electrolytic circuit by providing other means of supporting and electrically insulating or isolating the heat loss reducing member, such as a frame that supports the member from the walls of the envelope so as to create a path of high resistance back to the power supply. Arc tube lead 4, which previously was connected to dome support 19 of support 17 at 1 (FIG. 2), is now connected to the return conductor lead 43 (FIG. 1) which completes the lamp operating circuit to conductor 15.

Figure 4A:
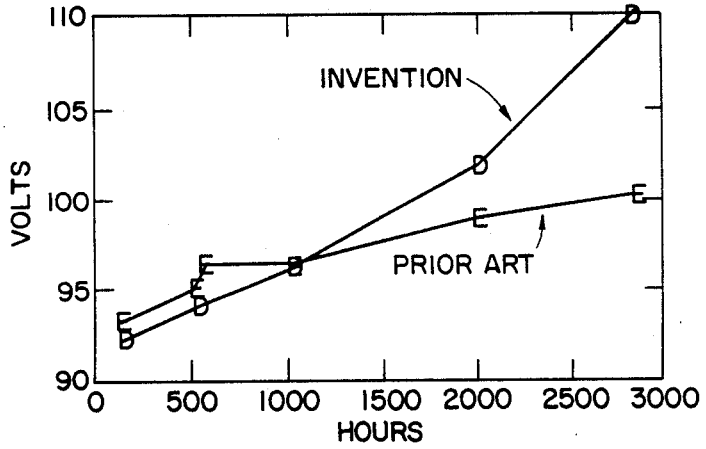
FIG. 4A–FIG. 4C illustrate in graphic form the data derived from measurements of the comparison as compiled in FIG. 3.
Figure 4B:
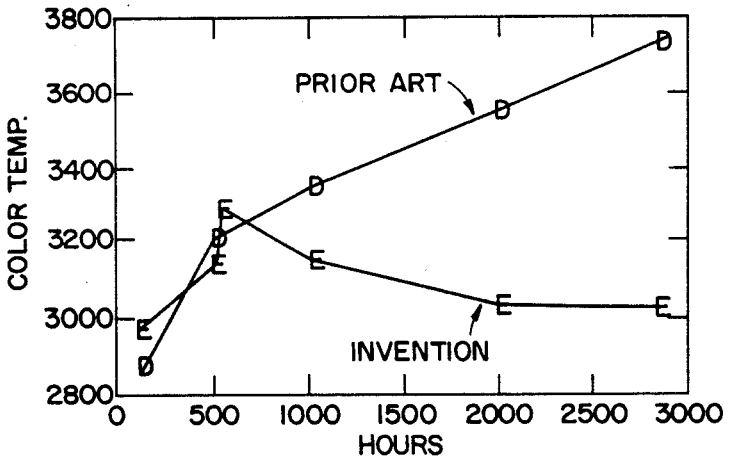
Figure 4C:
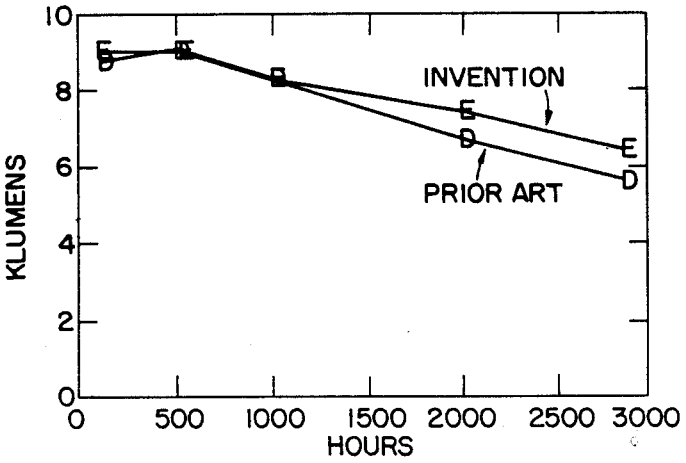

A test run of 19 lamps utilizing the invention as shown in FIG. 1 was life tested in typical fixtures to simulate the operating conditions expected in the field. A control group of prior art (FIG. 2) lamps was included in the test for comparison. Measurements of the performance characteristics over 3000 hours confirm the effectiveness of the invention FIG. 3 shows that while a prior art lamp showed an increase of 280° K in color temperature per 1000 hours and a color shift to 10 MPCD, the invention showed a decrease of 16° K per 1000 hours and no color shift. Voltage rise, another measure of sodium loss, rose only 2.5 volts per 1000 hours for the invention compared with 6.3 volts per 1000 hours for the prior art. The results shown in FIGS. 4A–4C illustrate the dramatic improvement in color control (FIG. 4B) and voltage stability (FIG. 4A). The lumen (FIG. 4C) data confirms that the initial efficacy and lumen maintenance are preserved in the present invention.

It should be understood that the reduction of sodium loss in accordance with the present invention is also applicable to high pressure sodium (HPS) lamps, particularly in the so-called high CRI (color rendering index) HPS lamps.

In FIG. 2, supporting rod 17 is electrically connected to one electrode of arc tube 33 to create a D.C. potential, during operation of the lamp circuit, between supporting rod 17 and the inner surface of the arc tube 33 with the result that a polarity exists so that the inside surface of quartz arc tube 33 is negative with respect to supporting rod 17. If it were not for the neutralization of these positive ions by photoelectrons from the support rod, the accumulation of positive charge on the outside surface of the quartz due to the migrating ions would repel positive ions and prevent the subsequent migration of any more sodium ions through the quartz. Thus the completion of the D.C. electric circuit by photoelectrons emitted from the supporting rod is a major factor in the rapid electrolytic loss of sodium metal from the arc tube. Accordingly, it is understood that the terms "interrupting the circuit for the current flow which sustains the electrolytic sodium loss process". "Photoelectron circuit", or comparable terms as used in the specification and claims relate to such D.C. electric circuits as described above.

While the invention has been described with respect to preferred embodiments, it will be apparent to those skilled in the art that changes and modifications may be made without departing from the scope of the invention as defined by the appended claims. Accordingly, it is intended that all matter contained in the above description or shown in the accompanying drawings, shall be interpreted as illustrative and not in limiting sense.

What is claimed is:

1. A metal halide discharge lamp comprising:

an evacuated glass envelope;

a stem member disposed within said envelope having a pair of electrical conductors sealed therein and passing therethrough;

a heat loss reducing member disposed within said envelope and having an outer metal band surrounding and affixed thereto;

an arc tube disposed within said heat loss reducing member containing a chemical fill including a halide of sodium and having two electrodes, one electrode being at each end of said arc tube with an outer strap member adjacent one of said electrodes;

means for electrically coupling each of said electrodes to each of said electrical conductors disposed within said envelope; and a support structure, said support structure being affixed to a portion of said envelope and affixed to said stem member by a strap member, said support structure supporting said arc tube by said outer strap member and supporting said heat loss reducing member within said envelope by said outer metal band, said support structure not being electrically connected to the arc tube electrodes or the electrical conductors of the lamp.

2. The metal halide lamp according to claim 1 wherein said means for electrically coupling each of said electrodes includes a pair of lead conductors coupled to each of said electrical conductors, one of said lead conductors passing through said heat loss reducing member and the other of said lead conductors disposed adjacent said heat loss reducing member.

3. The metal halide discharge lamp of claim 1 wherein said heat loss reducing member is in the form of a quartz sleeve.

4. The metal halide discharge lamp of claim 1 wherein said quartz sleeve has a domed end and an open end, said metal band is positioned adjacent said open end.

5. The metal halide discharge lamp of claim 1 wherein said chemical fill includes sodium and scandium iodides in a ratio of about 20:1 to 28:1.

* * * * *